United States Patent [19]

Moles et al.

[11] Patent Number: 4,562,048

[45] Date of Patent: Dec. 31, 1985

[54] PROCESS FOR THE TREATMENT OF METAL-BEARING ORES

[75] Inventors: Oliver W. Moles; Kenneth L. Ensley; Haywood A. Perkins, all of Mobile, Ala.

[73] Assignee: Kerr-McGee Chemical Corporation, Oklahoma City, Okla.

[21] Appl. No.: 605,475

[22] Filed: Apr. 30, 1984

[51] Int. Cl.[4] ..... C01G 23/00

[52] U.S. Cl. ..... 423/81; 423/27; 423/45; 423/46; 423/109; 423/150; 75/1 T

[58] Field of Search ..... 423/82, 86, 81; 75/1 T

[56] References Cited

U.S. PATENT DOCUMENTS

| | | | |
|---|---|---|---|
| 2,127,247 | 8/1938 | Dawson et al. | 423/86 |
| 2,406,577 | 8/1946 | Alessandroni et al. | 423/86 |
| 3,764,651 | 10/1973 | Henkel et al. | 423/86 |

FOREIGN PATENT DOCUMENTS

| | | | |
|---|---|---|---|
| 1191241 | 5/1970 | United Kingdom | 423/82 |

*Primary Examiner*—H. T. Carter

*Attorney, Agent, or Firm*—William G. Addison; John P. Ward

[57] ABSTRACT

In the hydrometallurgical treatment of metal-bearing ores and particularly the beneficiation of iron-containing titaniferous ores wherein the ore is subjected to leaching with a dilute aqueous acid solution in a digestion zone, there is provided an improvement which comprises initiating and maintaining the mixture of ore and acid in a state of boiling. Initiation and maintenance of the mixture in a state of boiling is accomplished through the venting of the digestion zone to remove process vapors substantially in the form of water vapor. Initiation of the boiling of the mixture of ore and acid solution in the digestion zone is commenced when the temperature of the mixture and consumption of the free acid solution in said mixture have reached predetermined values. The initiation and maintenance of the mixture in a state of boiling results in an increased rate of dissolution of the contaminant values in the metal-bearing ore.

7 Claims, No Drawings

PROCESS FOR THE TREATMENT OF METAL-BEARING ORES

FIELD OF THE INVENTION

The present invention relates to improvements in hydrometallurgical processes for the treatment of metal-bearing ores, said processes including the leaching of said ores with dilute aqueous acid solutions at elevated temperatures and pressures. More particularly, the invention relates to improvements in hydrometallurgical processes for the beneficiation of iron-containing titaniferous ore for the production of synthetic rutile. Most particularly, the present invention comprises initiating and maintaining controlled boiling of a leach mixture of a reduced iron-containing titaniferous ore and a dilute aqueous mineral acid solution in a digestion zone through controlled venting of the digestion zone, said controlled boiling providing an accelerated rate of dissolution of the iron constituents in said ore by the acid solution.

BACKGROUND OF THE INVENTION

Many hydrometallurgical processes are known and employed for the beneficiation of contaminant-containing metal-bearing ores to render said ores more suitable for metallurgical uses. However, one feature common to most, if not all, of these processes is the treatment of the metal-bearing ore with an aqueous mineral acid solution such as aqueous sulfuric, hydrochloric, nitric or phosphoric acid solutions and the like to effect a separation of contaminant values in the ore from the desired metal values in the ore. By such treatment, either the contaminant values are dissolved selectively from the ore to effect the desired separation or both the contaminant and the desired metal values are dissolved from the ore in which event the desired metal values are subsequently recovered from the aqueous acid solution by means such as, for example, hydrolysis.

A typical example of the hydrometallurgical processing of contaminant-containing metal-bearing ores is the beneficiation of iron-containing titaniferous ores for producing synthetic rutile. In the manufacture of synthetic rutile, an iron-containing titaniferous ore such as, for example, ilmenite is first subjected to reductive roasting in the presence of a reducing agent. The reduced ore then is leached with an aqueous mineral acid solution under conditions of elevated temperature and pressure to either selectively dissolve only the iron values in the ore or both the iron and the titanium values in the ore. In the event both the iron and the titanium values in the ore are dissolved upon leaching with the aqueous mineral acid solution, the titanium values then are recovered by means such as, for example, hydrolysis.

Whether only the iron values or both the iron and the titanium values are dissolved is determined by the concentration of the aqueous acid solutions employed. Thus, in processes which employ acid solutions having a free acid content of below about 30% of the total weight of the acid solution, the separation of the iron and titanium values in the ore is effected by selective dissolution of only the iron from the ore. See for example U.S. Pat. No. 3,787,139. By contrast, processes employing acid solutions having free acid contents equal to or greater than the above amount will result in the dissolution of both the iron and the titanium values. In these latter processes the final separation of the dissolved iron and titanium values is then accomplished by hydrolysis to precipitate the titanium values, as titanium dioxide, from the solution. See for example U.S. Pat. No. 3,518,054.

Most commercial hydrometallurgical processes for the manufacture of synthetic rutile effect the separation of the iron and titanium values in the titaniferous ores by means of dilute acid solutions. In such processes, the dissolution of the iron values from the ore generally is carried out under conditions of elevated temperature and pressure such that fairly reasonable rates of dissolution can be achieved. In addition, some mechanical means for agitating the ore/acid mixture is usually provided for, since it is known that agitation will also provide for increased dissolution rates. However, even under the most favorable conditions of temperature, pressure and agitation, dissolution times of at least about 12 or more hours are required to remove a substantial amount of the iron values in the ore and provide a residue, i.e., a synthetic rutile, containing 90% by weight or more of titanium dioxide.

Such protracted dissolution times not only increase the unit costs for manufacturing synthetic rutile but also reduce the production capacity for any given production facility. As illustrated by the manufacture of synthetic rutile, there exists a need for reducing the time required for the beneficiation of metal-containing ores in order to lower costs and increase production. The present invention provides such means.

SUMMARY OF THE INVENTION

In accordance with the present invention, there are provided improvements in processes for the hydrometallurgical treatment of metal-bearing ores. Processes to which the improvements of the present invention are particularly applicable are those processes which include the feature of leaching of a metal-bearing ore with dilute aqueous mineral acid solutions in a digestion zone, said leaching being carried out at elevated temperatures and pressures.

The improvements constituting the subject matter of the present invention comprise initiating controlled boiling of a leach mixture of a metal-bearing ore and a dilute aqueous acid solution in a digestion zone after the temperature in said zone and consumption of the free acid in said acid solution have reached predetermined values. The improvements further comprise maintaining said controlled boiling of the leach mixture for a time sufficient to provide for a substantial increase in the rate of separation of the contaminants and the desired metal values in the metal-bearing ore. In the practice of the present invention, the initiation and maintenance of the leach mixture in a boiling condition is provided for by controlled venting of the digestion zone to remove therefrom process vapors consisting mostly of water vapor. In a preferred embodiment, the improvements of the present invention are particularly applicable to the beneficiation of iron-containing titaniferous ore.

DETAILED DESCRIPTION OF THE INVENTION

It now has been discovered that, in processes for the hydrometallurgical treatment of metal-bearing ores, wherein said processes include the leaching of said ores, said leaching can be accelerated in a manner such that the processing time required to yield concentrated levels of the desired metal values is significantly reduced. In particular, the present invention resides in the discovery that, when the leaching of metal-bearing ores, such as, for example, copper, zinc and nickel bearing-ores and iron-containing titaniferous ores and the like, is carried out at elevated temperatures and pressures under conditions of controlled boiling, the time normally required for such leaching can be reduced by at least about 10%. In a most preferred embodiment, the invention relates to improvements in the hydrometallurgical beneficiation of iron-containing titaniferous ores for the production of synthetic rutile, and, by way of illustration, the following detailed description of the invention is specifically directed to this preferred embodiment.

In processes for the hydrometallurgical beneficiation of iron-containing titaniferous ores, the first step or stage in such processes is, generally, one of reduction wherein the iron in the ore, primarily in the form of ferric oxide, is reduced to ferrous oxide. The reason for reducing the ferric oxide in the ore to ferrous oxide is that the latter is removed more readily from the ore during leaching and, in addition, only requires two-thirds as much acid to effect its removal. Thus, the reduced ore useful in the practice of the present invention is characterized as containing 85% or more by weight of the total iron present in the ore in the ferrous oxidation state (i.e., as ferrous oxide). Preferably, 90% by weight or more of the total weight of iron in the ore should be in the ferrous oxidation state.

The reduction of the iron-containing titaniferous ore is carried out at elevated temperatures generally within the range of from about 600° C. to 1100° C. However, temperatures within the range of from about 650° C. to about 950° C. are preferred with those temperatures between about 800° C. and about 900° C. being most preferred.

The reduction of the iron-containing titaniferous ore, at elevated temperatures, is carried out in the presence of materials that promote the conversion of the ferric oxide in the ore to ferrous oxide. In general, materials that have been used in the reduction of titaniferous ores have been carbon-based materials. Representative examples of such materials include coke, fuel oils, gaseous hydrocarbons containing from one to four carbon atoms, partially burned natural gas and the like. In addition to these carbon-based materials, hydrogen and hydrogen-containing mixtures, such as water gas, also have been employed or can be employed to cause reduction of the ferric oxide in the ore to ferrous oxide.

Following reduction of the iron-containing titaniferous ore, the reduced ore then is blended with a dilute aqueous mineral acid solution such as an aqueous sulfuric or, preferably, hydrochloric acid solution in a digestion zone. In general, the free acid content of the acid solution will range from about 15 to about 20 weight percent of the total weight of the acid solution and preferably from about 17 to about 19 weight percent. The reduced ore and dilute aqueous acid solution are mixed together in such proportions as to provide an amount of free acid in said mixture in excess of that stoichiometrically required to dissolve and remove the iron oxides in the reduced ore. Usually the amount of free acid will range from about 10% to about 40% by weight and preferably from about 18% to about 30% by weight in excess of the stoichiometric requirement.

The leaching of the reduced ore with the dilute acid solution will be carried out in a digestion zone under conditions of elevated temperature and pressure. Elevated temperatures in the range from about 120° C. to about 150° C. will be employed with temperatures in the range of about 130° C. to about 145° C. being preferred. Elevated pressures employed in the digestion zone will range from about 10 to about 45 pounds per square inch gauge (psig) with pressures ranging from about 18 to about 38 psig being preferred.

In carrying out the improvement process of the present invention, it is preferred to preheat the dilute aqueous acid solution to a temperature within a range from about 115° C. to about 130° C. before adding it to the digestion zone containing previously charged reduced ore. By preheating the aqueous acid solution to temperatures within the above range, a quantity of heat is provided which can be utilized during the venting cycle to extend the enhanced rate of reaction between the iron oxides in the ore and the free acid in the aqueous acid solution caused by controlled boiling of the mixture. On completion of the addition of the acid, the digestion zone will be under or will be placed under an elevated pressure within the range specified above.

In addition to preheating the dilute aqueous acid solution, further supplemental heat can be supplied to the leach mixture of ore and acid by introduction of steam to the digestion zone. The steam can be introduced either above or below the level of the leach mixture of ore and acid solution in the digestion zone. In a preferred embodiment, the steam will be introduced into the digestion zone at a point below the surface of this leach mixture, since this will result in a more rapid utilization by the leach mixture of the heat content of the steam.

The reaction of the iron oxides in the ore with the dilute aqueous acid solution is exothermic, and, therefore, the reaction itself also provides a source of heat for utilization in the process. Observation of many leaching operations indicates that the exothermic reaction can cause as much as a 30° C. to 50° C. rise in the temperature of the leach mixture of reduced ore and acid solution in the digestion zone.

Applying the improvements of the present invention to the above specific teachings, it now has been observed that if, during the leaching of the reduced ore with the dilute aqueous acid solution under conditions of elevated temperatures and pressures such as those described hereinabove, the mixture of ore and acid solution is placed in a controlled state of boiling, the rate of leaching of the ore can be increased significantly. It is not known precisely how controlled boiling of the ore/acid mixture causes an increase in the rate of leaching. However, it is theorized that one possible explanation is that the ore particles undergo a sort of fluidization providing for significantly better mixing and, thus, better contact between the ore and acid solution in the digestion zone.

Since the leach mixture of reduced ore and dilute aqueous acid solution in the digestion zone is under conditions of elevated temperatures and pressures, the preferred means of initiating and maintaining controlled boiling of the mixture is through the controlled venting of the digestion zone to remove process vapors mostly in the form of water vapor. In this respect, it has been found that, by venting the digestion zone to remove from said zone these process vapors at a rate of from about $3.1\times10^{-2}$ to about $10.4\times10^{-2}$ parts per minute per 100 parts by weight of the reduced ore in the leach mixture, a rate of leaching can be achieved which effects a decrease in the normal dissolution times for the iron oxides of from about 10 to about 40 percent.

When boiling of the leach mixture is initiated and maintained by means of venting of the digestion zone, said venting of this zone may be performed either continuously or intermittently. When venting the digestion zone continuously, such venting will be carried out in such a manner as to maintain the rate of removal of process vapors within the range set forth above. If it is desired to initiate and maintain the leach mixture at the boil through the use of intermittent venting, then an actual rate of process vapor removal greater than about $10.4\times10^{-2}$ parts per minute per 100 parts by weight of reduced ore in the leach mixture can be employed. However, in such event, the overall average rate of process vapor removal must still come within the ranges set forth above. For example, if a digestion zone containing a leach mixture of reduced ore and dilute aqueous acid is vented intermittently to remove process vapors and, thereby, induce boiling of the mixture, and if the rate of removal of process vapors employed during the venting cycle is $14.6\times10^{-2}$ parts of process vapors per minute per 100 parts by weight of reduced ore in the leach mixture, then, in order to achieve an overall average rate of removal of $3.1\times10^{-2}$ parts per minute per 100 parts by weight of reduced ore in the leach mixture, the digestion zone would, in actuality, be opened (i.e., vented) for a period of one and one-half minutes and be closed for a period of five and one-half minutes in a seven minute cycle. If, in the above example, it is desired that the average overall rate of removal of process vapors be $10.4\times10^{-2}$ parts per minute per 100 parts by weight of reduced ore in the leach mixture, then the digestion zone would be opened for a period of five minutes and closed for a period of two minutes for the same seven minute cycle. Other actual operating rates can, of course, be employed when using an intermittent venting procedure, and the period of time when the digestion zone must be opened and closed to provide an average rate of removal of process vapors within the range described above will vary accordingly. However, one skilled in the art, given the above guidelines, can readily determine the period of time when the digestion zone must be opened and closed when employing such other operating rates to provide for an average rate of process vapor removal within the above specified range.

It has been found that, when employing intermittent venting techniques, the leach mixture will remain in a state of boil during the period of time between venting cycles. Such boiling will continue during this period or until such time that the vapor pressure of the leach mixture in the digestion zone has reached its equilibrium vapor pressure. Generally, however, this period of time between venting cycles is of such short duration that the equilibrium vapor pressure of the system will not be reached prior to the start of the next venting cycle. Therefore, boiling of the leach mixture will be continuous even though the venting of the digestion zone is carried out only intermittently. Preferably, venting of the digestion zone to induce and maintain boiling of the leach mixture of reduced ore and dilute aqueous acid solution by removal of process vapors will be carried out on a continuous basis.

In addition to the rate of removal of process vapors through venting of the digestion zone, the point in time at which such venting is initiated is also critical to obtaining full advantage of the boiling of the leach mixture. For example, if the time of initiation of boiling of the leach mixture, by venting of the digestion zone to remove process vapors, occurs too early in the leaching process, then cooling of the leach mixture by the action of boiling can actually slow down the leaching reaction. This can result in either incomplete dissolution of the iron oxides in the reduced ore or require longer processing times or both, thus offsetting the benefits to be derived from the invention. Conversely, if boiling of the leach mixture by venting of the digestion zone is commenced only after a substantial period of processing has elapsed, then the maximum savings in processing time cannot be realized.

As noted hereinabove, the reaction between the reduced ore and aqueous acid solution is exothermic, and this fact offers one means for determining the point at which boiling of the leach mixture can be initiated. Thus, it has been found that, if boiling of the leach mixture is initiated following a temperature rise due principally to the exothermic reaction, increased rates of dissolution of the iron values in the reduced ore can be achieved with a concomitant decrease in process times.

Generally, however, experience has shown that, when venting of the digestion zone is commenced at a point in the leaching process when the temperature of the leach mixture in said zone ranges from about 135° C. to about 140° C., increased rates of dissolution of the iron values in the ore can consistently be achieved, together with a concomitant decrease in process times.

Observation and experience also have shown that, if venting of the digestion zone is commenced when the consumption of the free acid in the dilute aqueous acid solution has reached a value within the range of from about 40 to about 80 weight percent of the total free acid in the initial acid solution, faster rates of dissolution of the iron values in the ore can be obtained. Thus, monitoring of the decreasing free acid concentration in the reduced ore/acid leach mixture in the digestion zone provides yet another means for determining the time at which venting of the digestion zone should be initiated.

In actual practice, it is preferred to initiate venting of the digestion zone to cause boiling of the reduced ore/acid leach mixture therein when said mixture has reached a temperature within the range specified hereinabove. Not only is the temperature of the reduced ore/acid leach mixture more easily monitored than acid concentration, but, generally it has been found that, by the time the mixture has reached a temperature within the above specified range, the weight percent of free acid that will have reacted also will have attained a value within the above specified range.

The following nonlimiting examples are presented as being illustrative of the practice of the present invention. In these examples, all parts and percentages are by weight unless indicated otherwise.

EXAMPLE I

To demonstrate the improvements of this invention, a Western Australia iron-containing titaniferous ore is mixed with heavy fuel oil and reduced at elevated temperatures in a rotary kiln. The reduced ore, having a weighted average particle diameter of 150 microns, contains 60.8% $TiO_2$, 4.0% $Fe_2O_3$, 32.9% FeO and 0.39% carbon.

One hundred (100) parts by weight of the reduced ore are charged to a rotatable ball digester equipped with inlet and outlet means for adding a dilute aqueous acid solution and steam and for venting of process vapors and removal of spent leach liquor. On completion of the charging of the reduced ore, the digester is sealed, and 137 parts by weight of an aqueous hydrochloric acid solution, heated to a temperature of about 115° C. and containing 17.8% by weight of free acid, then is charged to the digester.

When all of the aqueous acid solution is contained in the digester, the digester is rotated to provide mixing of the leach mixture of reduced ore and acid solution, and steam is introduced into the digester above the level of the leach mixture to provide heat to the mixture. Leaching of the ore with the aqueous acid solution is continued for a period of three hours and six minutes at which time about 60% by weight of the free acid in the original aqueous acid solution is consumed and the temperature of the leach mixture has increased to about 138° C. Heating of the leach mixture with steam then is discontinued, and venting of the digester is commenced to induce and maintain controlled boiling of the leach mixture and to remove process vapors consisting mostly of water vapor at a rate of $3.1\times10^{-2}$ parts per minute per 100 parts by weight of the reduced ore in the leach mixture. Venting of the digester and removal of process vapors is continued for a period of 121 minutes during which time the pressure in the digester decreases from about 37 psig to about 19 psig. At this time, 139 parts by weight of spent aqueous acid solution are removed from the digester. Analysis of the spent solution indicates that approximately 93% of the free acid in the original aqueous acid solution is consumed during the above leaching operation.

Following removal of the above quantity of spent aqueous acid solution, an additional 122 parts by weight of fresh aqueous hydrochloric acid solution containing 17.8% by weight of free acid are added to the ball digester. Digestion of the partially digested reduced ore therein then is continued in the same manner as above for a period of three hours and fifteen minutes at which time the temperature is about 140° C. and about 50% by weight of the free acid in the original aqueous acid solution is consumed. Venting of the digester is then commenced, to again induce and maintain controlled boiling of the leach mixture and removal of process vapors, at a rate of about $3.1\times10^{-2}$ parts per minute per 100 parts by weight of reduced ore in the leach mixture. Venting of the digester and removal of process vapors is continued for a period of one hour and twenty-two minutes during which time the pressure in the digester decreases from about 37 psig to about 20 psig. At this time, the pressure in the ball digester is further reduced to atmospheric pressure, and the spent aqueous acid solution is removed from the digester. The processed ore then is washed with water and dried to provide a synthetic rutile containing about 2.5% by weight of $Fe_2O_3$. The total time involved in leaching the reduced ore is 9.7 hours.

COMPARATIVE EXAMPLE

A comparative example is conducted using the same equipment, materials and amounts thereof, and procedures as in Example I, with the exception that venting of the digester, to induce and maintain boiling of the leach mixture and removal of process vapors, is not employed. The total time required to leach the reduced ore and produce a synthetic rutile product containing about 2.5% by weight of $Fe_2O_3$ is 11.6 hours.. A comparison of the processing time for Example I, wherein venting and controlled boiling is employed, with that for this Comparative Example, wherein no venting and boiling is employed, discloses a reduction of 1.9 hours in actual processing time. This difference represents a 16.4% savings in leaching time and a proportional savings in processing costs.

EXAMPLE II

The process of Example I is repeated with the exception that venting of the digester to induce and maintain controlled boiling of the leach mixture of reduced ore and aqueous acid solution is carried out in an alternating manner rather than on a continuous basis as in Example I. Thus, in this Example II, the digester is alternately opened (i.e., vented) and closed, the digester being opened for a period of two minutes to allow removal of process vapors, mostly water vapor, at a rate of $11.0\times10^{-2}$ parts per minute per 100 parts by weight of the reduced ore in the leach mixture and then closed for a period of five minutes. Repeating this opening and closing procedure will result in an average rate of removal of process vapors of about $3.1\times10^{-2}$ parts per minutes per 100 parts by weight of the reduced ore in the leach mixture. Total process time required to produce a synthetic rutile containing about 2.5% by weight of $Fe_2O_3$ employing this alternating procedure is 9.44 hours as compared with the 11.6 hours required in the Comparative Example in which no venting is employed. The difference of 2.2 hours represents an 18.6% savings in leaching time.

While the invention herein has been described in terms of what at present are believed to be the preferred embodiments thereof, it is to be understood that this invention is not be be limited to these specific embodiments and that changes thereto may be made without departing from the spirit and scope thereof except as provided in the following claims.

What is claimed is:

1. In a hydrometallurgical process for the treatment of an iron-containing titaniferous ore, said process including leaching of said ore in a digestion zone with dilute aqueous mineral acid solutions selected from the group consisting of dilute sulfuric, hydrochloric, nitric and phosphoric acid solutions having free acid contents of below about 30 weight percent at elevated temperatures and pressures, the improvements which comprise:

initiating controlled venting of said digestion zone to remove process vapors, substantially in the form of water vapor, from said digestion zone and to cause boiling of the mixture of said ore and acid solution in the digestion zone, said venting being initiated after the temperature of the mixture has reached a value of from about 135° to about 140° C. and consumption of the free acid in said mixture has reached a value of from about 40 to about 80 weight percent of the free acid in said dilute aqueous acid solution and continuing the venting of said digestion zone to remove the process vapors from said digestion zone and to maintain the mixture of said ore and said acid solution in the digestion zone in a state of boiling, said venting of the digestion zone and boiling of said mixture of said ore and said acid solution providing for increased contact between said ore and said acid.

2. The improvement of claim 1 wherein said iron-containing titaniferous ore is a reduced titaniferous ore.

3. The improvement of claim 1 wherein the process vapors are removed from said digestion zone at an average rate within the range of from about $3.1\times10^{-2}$ to about $10.4\times10^{-2}$ parts per minute per 100 parts by weight of the ore in said mixture of ore and acid solution in said digestion zone.

4. The improvement of claim 3 wherein the process vapors are removed from said digestion zone continuously.

5. The improvement of claim 1 wherein said dilute aqueous mineral acid solution is an aqueous hydrochloric acid solution wherein the free hydrochloric acid content of said solution ranges from about 15 to about 20 weight percent of the total weight of said acid solution.

6. In a hydrometallurgical process for the beneficiation of an iron-containing titaniferous ore, said process including reduction of the iron-containing titaniferous ore in a reduction zone and the leaching of the iron from said ore with a dilute aqueous hydrochloric acid solution having a free acid content of below about 30 weight percent at elevated temperatures and pressures in a digestion zone, the improvements which comprise:

initiating controlled venting of said digestion zone to remove process vapors, substantially in the form of water vapor, from said zone and to cause boiling of the mixture of said ore and said acid solution in the digestion zone, said venting being initiated after the temperature of the mixture has reached a value of from about 135° C. to about 140° C. and consumption of free acid in said mixture has reached a value of from about 40 to about 80 weight percent of the free acid in said dilute aqueous acid solution and continuing the venting of said digestion zone to remove continuously the process vapors from said digestion zone to continuously maintain the mixture of said ore and said acid solution in the digestion zone in a state of boiling, said venting of the digestion zone and boiling of the mixture of said ore and said acid solution providing for increased contact between said ore and said acid.

7. The improvement of claim 6 wherein the process vapors, substantially in the form of water vapor, are continuously removed from the digestion zone at a rate within the range of from about $3.1\times10^{-2}$ to about $10.4\times10^{-2}$ parts per minute per 100 parts by weight of the reduced ore in said mixture of reduced ore and acid solution in said digestion zone.

* * * * *